United States Patent [19]

Dotson

[11] Patent Number: 4,584,570

[45] Date of Patent: Apr. 22, 1986

[54] ELECTRICAL APPLIANCE PLUG REMOVAL ALARM

[75] Inventor: A. Steve Dotson, Pelver, S.C.

[73] Assignee: Eamon Solan, Boston, Mass.

[21] Appl. No.: 433,621

[22] Filed: Dec. 12, 1983

[51] Int. Cl.[4] ..... G08B 21/00

[52] U.S. Cl. ..... 340/568; 200/51.1; 340/638

[58] Field of Search ..... 340/568, 638, 639; 200/61.59, 61.58, 51.1

[56] References Cited

U.S. PATENT DOCUMENTS

| | | | |
|---|---|---|---|
| 4,002,397 | 1/1977 | Wang et al. | 340/568 |
| 4,009,474 | 2/1977 | Eller | 340/568 |
| 4,189,723 | 2/1980 | Hylton | 340/568 |
| 4,195,290 | 3/1980 | Magil et al. | 340/568 |
| 4,263,589 | 4/1981 | Lewiner et al. | 340/638 |
| 4,300,130 | 11/1981 | Fotheringham et al. | 340/568 |

*Primary Examiner*—Glen R. Swann, III

*Attorney, Agent, or Firm*—Richard F. Benway

[57] ABSTRACT

A security system for motels and other properties such as offices and rental properties where small appliances such as television sets, radios, lamps and others are plugged into electrical outlets within rented rooms and which are easily removed by the rentor consists simply of a small disc placed between the appliance's electrical plug and the outlet and if removed, causes the breaker in the circuit feeding that outlet to blow. If a tenant tries to cut the wires without removing the electrical plug, the circuit breaker will also blow. With the circuit breaker blown the tenant must contact the motel manager in order to see what he is removing from the room. An alarm attached to the circuit breaker at the fuse panel sounds when that circuit has no power. The potential signals for separated breakers can be accumulated through a telemetry circuit and are sent to the central office, which will immediately dispatch a house security officer to stop the removal of the appliance or other piece of equipment.

2 Claims, 9 Drawing Figures

ELECTRICAL APPLIANCE PLUG REMOVAL ALARM

BACKGROUND OF THE INVENTION

Security systems and devices to implement such systems have been used for quite some time because it is recognized that small appliances are expensive and that their theft or unauthorized removal is a very expensive cost associated with the operation of rental properties. With today's larceny of other equipments such as copiers, dictating machines, typewriters and even computers, some means of preventing the unauthorized removal of these appliances is also desirable. Prior art systems required, of course, that the outlets be modified or that the appliance be modified in such a way that alarms were built into the units or built into the house wiring, and low voltage and high voltage wiring were mixed in the same box and specialized wiring had to be instituted in order to effectuate such systems.

The present system obviates any need to modify the appliance or the need to re-wire or alter the standard electrical outlets that are supplied with modern building wiring.

The present invention contemplates the fabrication of a little device which is physically thin, slips over the prongs of the electrical plug (male plug) of any appliance before it is plugged into the electrical outlet. Once the unit is installed it sets itself in such a manner that when the appliance is unplugged the circuit breaker is blown. At the fuse box where the circuit breaker is located each circuit breaker is wired to an alarm such that when one of the circuit breakers blows an alarm will go off indicating to the owners that someone is attempting to remove an appliance. The examination of the circuit breakers at the fuse panel will disclose which of the rooms where an unauthorized removal of an appliance is being attempted.

In many elaborate motel arrangements with hundreds of rooms that are rented or very large hotels it is possible for the manager or desk clerk to know when a circuit breaker has blown. For a large system each of the circuit breakers will be collected together and a telemetric signal will be sent to the central office indicating when and where a circuit breaker has blown. Such a system would not distinguish whether the circuit breaker has blown as the result of the unauthorized removal of the appliance or that there had been some other electrical difficulty. The desk clerk would have to dispatch somebody to the scene in order to investigate as quickly as possible which has occurred and would have the excuse that he was checking out an electrical problem.

SUMMARY OF THE INVENTION

Therefore, an object of the present invention is to prevent the theft or unauthorized removal of appliances from hotels, motels or other rented places.

Another object of the present invention is to provide a simple device attachable to an appliance's electrical plug which when plugged into an electrical outlet will cause the circuit breaker to blow when the plug is removed.

Another object of the present invention is to provide a security system which will cause circuit breakers to blow when the appliances are removed or unplugged and an alarm sounded whenever the circuit breaker is blown.

Another object of the present invention is to provide a security system that will communicate where and when a circuit breaker has blown to a central which will trigger an immediate investigation.

BRIEF DESCRIPTION OF THE DRAWINGS

Other objects, features and advantages of the present invention will be better understood from the following detailed specification, especially when read in conjunction with the attached drawings of which.

DESCRIPTION OF THE PREFERRED EMBODIMENT

Figure 1A:
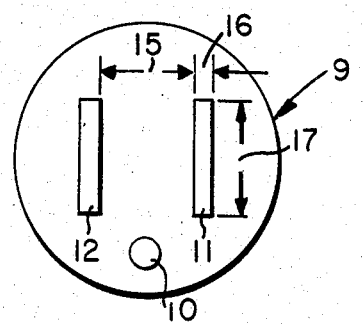
FIG. 1*a* is a front view of a standard electrical plug.
Figure 1B:
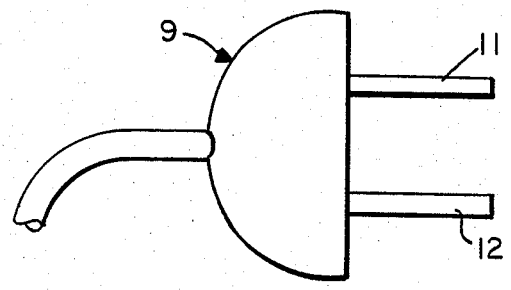
FIG. 1*b* is a side view of a standard electrical plug.

FIG. 1*a* is a front view of an ordinary plug 9 with two brass studs 11 and 12 that are separated a standard distance 15 and have standard thickness t 16 and width d 17. Occasionally a grounding plug 10 is used but is unneeded in the present invention. FIG. 1*b* shows the more familiar view of a standard plug found on most appliances which are installed into an electrical outlet to provide power to an appliance. Its shape is unimportant in the present invention as will be seen more clearly as we proceed.

Figure 2:
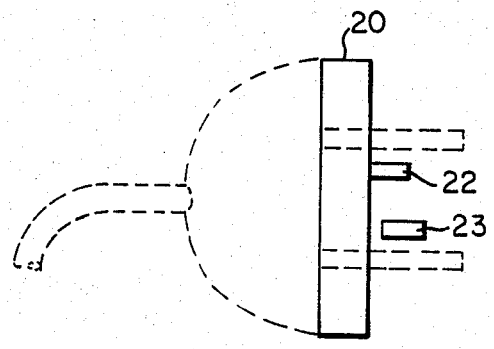
FIG. 2 is a side view of the present invention with an electrical plug in phantom.

FIG. 2 shows the plug above in phantom and the present invention which is installed over the appliance's electrical plug and will, therefore, lie between the electrical plug and the electrical wall outlet once the appliance is installed.

Three pins project from wafer 20. Pins 22 and 23 are shown in FIG. 2. Pin 24, the smallest of the set, appears in FIGS. 3, 4*a*, and 4*b*.

When setting the device, small pin 24 is slid over in its track and compresses a spring forming a spring loaded shorting bar. When fully compressed, a spring loaded setting pin #22 catches the shorting bar and holds the shorting bar in place. When it is released it will short out the plug. When the plug is plugged in with the wafer in place spring loaded blocking pin 23 blocks the path of the shorting bar when pin #22 releases. The only thing now preventing a short is pin #23, which is spring biased out of the path of shorting bar 31 but held in its path by contact with the wall outlet. If the plug is now removed the circuit breaker will blow because the blocking in 23 will slide out of the way as the plug 9 is removed from an electrical outlet.

Figure 3:
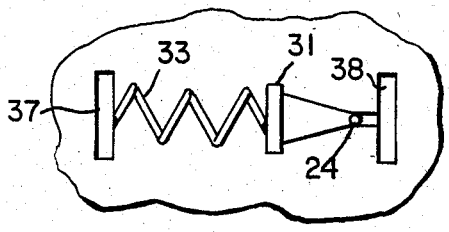
FIG. 3 is a sectional view of the present invention when blown.
Figure 4A:
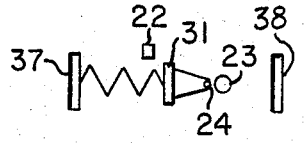
FIG. 4 is a symbolic view of the operation and setting of the present invention.
Figure 4B:
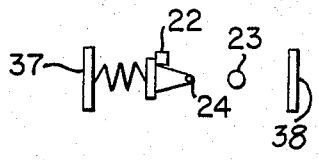

Referring to FIG. 3 you see a section of the wafer in perspective. Two plug openings #37 and #38 permit the prongs of the plug to pass right through the wafer. Spring #33 electrically connects the end of this opening such that a metal contact would be made at #37 with one of the brass studs of the electrical plug as it passes through it. At the other opening, #38, the shorting bar when fully extended by means of the spring #33, will tough the other brass stud of the electrical plug that is passing through it, thereby causing a short circuit. Pin #24, in cooperation with a small slot extending through the disc surface 20 will guide the shorting bar so that it will not move around within the disc and also permits the user to set the shorting bar by pushing on it and compressing spring #33 so that it is fully compressed. Pin #22 will catch it and hold it in place.

Referring now to FIG. 4(*a*), the set pin #22 will catch on to shorting bar #31 and hold it in place. FIG. 4(*b*) shows this accomplished. When the unit is installed in the wall, the blocking pin #23 which is spring loaded is first engaged by the electrical wall outlet and when pushed in against its spring forms a blocking pin. That is, once #23 is engaged, i.e. pushed in about a quarter of an inch, the path of the shorting bar #31 is completely blocked even when the set pin #22 releases the shorting bar #31. A short further push of the plug into the wall outlet causes pin #22 to be released, and shorting bar #31 comes in contact with the blocking pin #23. Now the appliance is energized because the prongs 10 and 11 are into electrical connection with the wall socket connectors. They are fully energized at this point and will provide current to the appliance. If someone tries to remove the plug, as soon as it is pulled out about an eighth of an inch, the block pin #23 will no longer block the shorting bar #31 and it will spring forward and strike the prong, passing through slot #38, thereby causing the circuit breaker to sense a dead short, and the circuit breaker blows.

Figure 5:
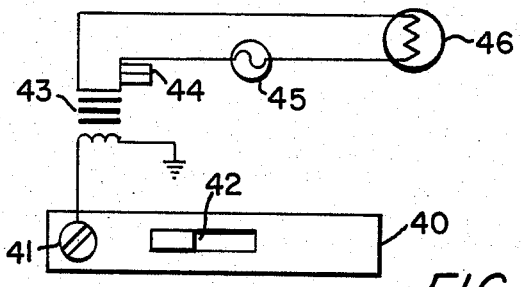
FIG. 5 is an alarm wired to a circuit breaker.

Referring now to FIG. 5, we see a circuit breaker 40 which is one of a large number in the fuse box with a hot side 41. The setting switch 42 will cause power to appear at 41. However, if one of the appliances is tripped, causing the breaker to trip, there is no power at 41. A relay 43 will cause contacts 44 to close, and the power source 45 will cause bell or light 46 to be energized thereby sounding an alarm telling the property owners that a circuit breaker has tripped and perhaps one of their customers has, without authority, attempted to remove an appliance from their property. An investigator, of course, would be dispatched immediately to discover what the problem was in that particular room or suite an if the appliances were removed from the wall, they could then eject the thief or have the police make an arrest if necessary, but would, in any event, save the loss of an appliance.

Figure 6A:
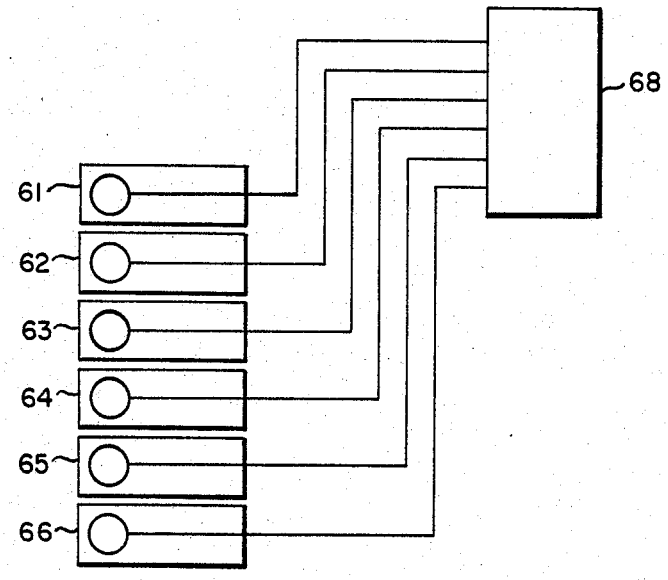
FIG. 6*a* is a block diagram of the accumulation of circuit breaker operations to transmit to a central location.
Figure 6B:
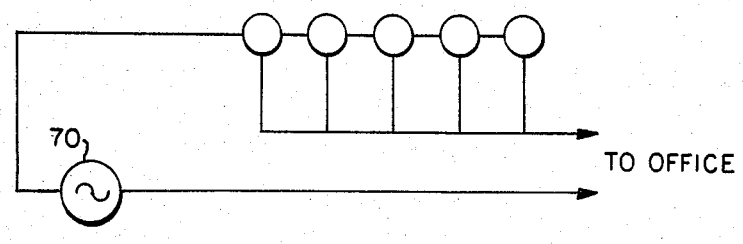
FIG. 6*b* is a simplified showing of accumulating signals for sending to a central office.

Referring now to FIG. 6*a*, we see a number of circuit breaker outlets in a very large hotel as 61, 62, 63, 64, 65 and 66. A transistorized accumulator, which is merely a set of relays that will provide a single signal when any one of the breakers blow which would be dispatched to the main desk telling the operator that a particular circuit block has a blown breaker. A detailed circuit diagram for this circuit is deemed unnecessary. In its simplest form (FIG. 6*b*), it is merely a collection of relays for each fuse block any one of which would send a separate signal of low voltage, preferably over the telephone wires, or of high frequency over the regular power line to the main office.

Although I have described my invention with reference to specific apparatus, I do not wish to be limited thereto. I only wish to be limited by the appended claims.

I claim:

1. Security system apparatus comprising in combination with an electrical outlet and mating electrical appliance plug, a wafer of insulating material having holes therethrough and positioned to receive an electrical appliance plug whereby the wafer is interposed between said plug and said outlet when the appliance is plugged in, a spring loaded shorting bar within said disk disposed to short the studs of said plug when said spring is fully extended, a first spring loaded pin which blocks said shorting bar when the appliance is plugged in, a second spring loaded pin for holding said shorting bar in setting the device which releases said shorting bar after said blocking pin engages when said plug is plugged into said electrical outlet, said shorting bar having a third pin which mates with a track in said wafer and extends out of said wafer whereby the shorting bar can be set for installation on said electrical plug.

2. Security system apparatus according to claim 1 which further includes alarm means which triggers when a circuit breaker blows.

* * * * *